US006962532B2

(12) United States Patent
Hasebe et al.

(10) Patent No.: US 6,962,532 B2
(45) Date of Patent: Nov. 8, 2005

(54) LASER GUN AND SHOOTING SYSTEM FOR THE SAME

(75) Inventors: Hiroyuki Hasebe, Tokyo (JP); Makoto Oki, Tokyo (JP)

(73) Assignee: NEC Corporation, Tokyo (JP)

( * ) Notice: Subject to any disclaimer, the term of this patent is extended or adjusted under 35 U.S.C. 154(b) by 167 days.

(21) Appl. No.: 10/205,347

(22) Filed: Jul. 25, 2002

(65) Prior Publication Data

US 2003/0027613 A1 Feb. 6, 2003

(30) Foreign Application Priority Data

Jul. 31, 2001 (JP) ..... 2001-232896

(51) Int. Cl.[7] ..... A63F 9/02
(52) U.S. Cl. ..... 463/51; 463/49; 463/53
(58) Field of Search ..... 434/19, 21, 22, 434/23; 463/50–54

(56) References Cited

U.S. PATENT DOCUMENTS 4,063,368 A * 12/1977 McFarland et al. ..... 434/22
4,083,560 A * 4/1978 Kikuchi et al. ..... 434/22
4,102,059 A * 7/1978 Kimble et al. ..... 434/22
5,366,229 A 11/1994 Suzuki
5,907,930 A * 6/1999 Ricco, Sr. ..... 273/404
6,322,365 B1 * 11/2001 Shechter et al. ..... 463/51
6,575,753 B2 * 6/2003 Rosa et al. ..... 434/16

FOREIGN PATENT DOCUMENTS

JP 2000-61138 2/2002
JP 2002-318098 10/2002

OTHER PUBLICATIONS

Patent Abstracts of Japan, No. 02 280787A, Nov. 16, 1990.
Patent Abstracts of Japan, No. 03 139377A, Jun. 13, 1991.

* cited by examiner

*Primary Examiner*—Jessica Harrison
*Assistant Examiner*—Robert Mosser
(74) *Attorney, Agent, or Firm*—Scully, Scott, Murphy & Presser

(57) ABSTRACT

In a laser gun, a signal generating unit generates an emission permission signal in response to a shooting permission signal. A laser beam bullet emitting unit emits a laser beam bullet based on the emission permission signal generated by the signal generating unit in response to an operation of the trigger.

45 Claims, 13 Drawing Sheets

LASER GUN AND SHOOTING SYSTEM FOR THE SAME

BACKGROUND OF THE INVENTION

1. Field of the Invention

The present invention relates to a laser gun, a target box, a shooting box and a laser gun shooting system.

2. Description of the Related Art

Shooting competitive sports are known. In such shooting competitive sports, it has been desired that a laser gun should substitute a gun for shooting with live bullets which need much care in view of safety and handling. There are various types of laser guns, e.g., a laser gun using flash light which has been developed for the shooting sport, and a laser gun used for exercises and connected with a computer with a cable to display the bullet arrival.

It has been demanded that the laser gun should be connected with no cable. Also, it has been demanded to establish a more strict one-to-one relationship between a laser gun and a target. Hence, it has been desired to supply an optical system in which the precision in detecting a position shot by a laser beam is improved. Further, it is important to secure safety of the laser gun which emits a laser beam. These demands need to be satisfied, in addition to improvements in precision and speed of a score calculation process.

With the score calculation process, the center point in a cross-section of a conical flash light emitted from the laser gun needs to be calculated from position coordinates of a plurality of points on a target. However, there is a limitation on improvements in determination precision of a shot position in a shooting system using the flash light gun.

In the laser gun connected with a computer by an electric wire cable, the wire cable affects the shooter's sense which has become very sharp, and hinders mental stability and concentration of the shooter. Also, there is a possibility that a shooter having a laser gun modifies the gun to process data a shot position by the laser beam. Otherwise, if the organizers keep guns or parts thereof, shooters cannot exercise.

Thus, it was difficult to use the laser gun for the shooting competitive sports. In conventional methods, laser beam bullets can hit on adjacent targets, so that a beginner may interrupt an adjacent user. Also, from the viewpoint of smooth managing of a shooting game, the fairness of calculating scores, preparations before the start of the game, well-organized score displays and other factors may be very important for a shooting system.

SUMMARY OF THE INVENTION

An object of the present invention is to provide a laser gun connected to any unit without a wire, a shooting box, a target box, and a laser gun shooting system using the laser gun and the shooting box.

Another object of the present invention is to provide a laser gun for which the use of bullets can be strictly limited, and a shooting box, a target box, and a laser gun shooting system using the laser gun and the shooting box.

Another object of the present invention is to provide a laser gun that can emit a laser beam bullet safely, and a shooting box, a target box, and a laser gun shooting system using the laser gun and the shooting box.

Another object of the present invention is to provide a laser gun, a target box, shooting box and a laser gun shooting system that allows accurate and quick calculation of scores.

Another object of the present invention is to provide a laser gun, a target box, a shooting box and a laser gun shooting system that are useful for smooth management a shooting sport.

Another object of the present invention is to provide a laser gun, a target box, a shooting box and a laser gun shooting system that can give rise to new shooting techniques for using laser beam bullets.

In an aspect of the present invention, a laser gun includes a signal generating unit which generates an emission permission signal in response to a shooting permission signal, and a laser beam bullet emitting unit which emits a laser beam bullet based on the emission permission signal generated by the signal generating unit.

The laser gun may further include a trigger. The laser beam bullet emitting unit generates the laser beam bullet based on the emission permission signal in response to an operation of the trigger.

Also, the laser gun may further include a battery detachably arranged in an upper half portion of the laser gun. Also, the laser gun may further include a switch group arranged at a lower portion of the laser gun and used to define a state of the laser gun. In this case, it is desirable that each of switches of the switch group has a projecting part allowing a gun shooter to touch and confirm a selected position of the laser gun. Also, the switch group may include a first switch used to define a power on/off state of the laser gun, and a second switch used to set the laser gun to one of a plurality of shooting modes. The plurality of shooting modes desirably include a real shooting mode for allowing the emission of the laser beam bullet, and a test shooting mode for not allowing the emission of the laser beam bullet. In addition, the laser gun may further include a grip section detachably fitted to a main body of the laser gun. Also, it is desirable that the laser gun is cordless.

Also, the laser beam bullet emitting unit emits a bullet timing signal regardless of existence or non-existence of the trigger operation, and emits the laser beam bullet in response to the bullet timing signal. In this case, the laser beam bullet may include a plurality of elementary laser beam bullets, and a number of the elementary beam bullets emitted for a single operation of the trigger is desirably predetermined. Also, the laser beam bullet includes a laser beam bullet signal. The laser beam bullet signal may include a laser beam bullet identifying signal used to identify the laser beam bullet from other laser beam bullets emitted in response to another trigger operation and generated in response to the trigger operation.

In this case, the laser beam bullet identifying signal includes a plurality of bullet distinguishing signals for the plurality of elementary beam bullets, and it is desirable that the plurality of bullet distinguish signals are sequentially emitted after the bullet timing signals, respectively. In this case, each of the plurality of bullet identifying signal includes an in-bullet signal associated with a corresponding one of the plurality of elementary laser beam bullets, and a common signal indicating that the corresponding elementary laser beam bullet belongs to the laser beam bullet.

The in-bullet signal is expressed by a first number of bits, and the common signal and the second common signal is expressed by a second number of bits. Especially, it is desirable that the first number of bits is equal to 2 and the second number of bits is equal to 6.

In another aspect of the present invention, a laser gun shooting system includes the above-mentioned laser gun, a target box toward which a plurality of the laser beam bullets are emitted from the laser gun, and a scoring unit which calculate a shooting score of the plurality of laser beam bullets against the target box. In this case, the laser beam bullet shooting system may further include a display apparatus which displays shot positions of the target box shot by the plurality of laser beam bullets emitted from the laser gun.

Also, the target box may transmit the shooting permission signal to the laser gun repeatedly in a predetermined time interval. Also, the laser beam bullet may include a plurality of elementary laser beam bullets. The laser beam bullet includes a laser beam bullet identifying signal used to identify the laser beam bullet from other laser beam bullets. The laser beam bullet identifying signal includes a plurality of bullet distinguishing signals for the plurality of elementary beam bullets. The plurality of bullet distinguish signals are sequentially emitted after the bullet timing signals, respectively. In this case, the target box may convert each of the plurality of laser beam bullets into an electric signal. The electric signal may include a common signal common to the plurality of elementary laser beam bullets, and a specific signal specific to each of the plurality of elementary laser beam bullets.

The scoring unit may calculate, as the shooting score for the leaser beam bullet, an average of scores for the plurality of shot positions of the plurality of elementary laser beam bullets based on the common signal and the specific signals. Alternatively, the scoring unit may calculate, as the shooting score for the leaser beam bullet, a plurality of scores for the shot positions of the plurality of elementary laser beam bullets based on the common signal and the specific signals.

Also, the target box may generate a signal indicating a trace of the shot positions of the plurality of elementary laser beam bullets based on the common signal and the specific signals. The laser gun shooting system may further include a display unit which displays the trace based on the trace indicating signal.

The display unit may be supported by the target box. And, the display unit may be electrically connected to the target box and separated from the target box.

In another aspect of the present invention, a target box used in the laser beam bullet shooting system, includes a box main body, a target supported by the box main body, a transmitting unit supported by the box main body and adapted to transmit the shooting permission signal, and a light receiving unit supported by the box main body and adapted to receive the laser beam bullets.

The transmitting unit may emit a conically-shaped light beam having a directionality directed to a shooting area for the laser gun as the shooting permission signal. A horizontal range of the directionality desirably defines a horizontal range of the shooting area.

The transmitting unit may further include a slit supported by the box main body, and arranged in front of the transmitting unit. Also, the slit may be detachably secured to the box main body.

The target is desirably detachable. Also, the target is desirably secured in position by using a plurality of aligning holes arranged at the box main body and detachably fitted to the box main body.

The light receiving unit may detect a shot position of the laser beam bullet based on a specific signal specific to the laser beam bullet. Also, the light receiving unit may include a photo-sensing device adapted to generate electric currents corresponding the shot position of the laser beam bullet.

Also, the light receiving unit may include an optical element which optically receives the laser beam bullets, and an electronic unit for converting each of the received laser beam bullets into an electric signal. The electric signal includes a bullet number signal indicating a bullet number of the laser beam bullet. Also, each of the plurality of laser beam bullets contains a plurality of elementary laser beam bullets. The light receiving unit may include an optical element which optically receives the laser beam bullets, and an electronic unit for converting each of the received laser beam bullets into an electric signal. The electric signal may include a common signal common to the plurality of elementary laser beam bullets, and a specific signal specific to each of the plurality of elementary laser beam bullets. It is desirable that any laser beam bullets emitted from the laser gun without the shooting permission signal are invalidated.

In another aspect of the present invention, a shooting box used in the above laser gun shooting system may include partition walls for partitioning and defining a shooting area for positioning the laser gun opposite to the target box.

DESCRIPTION OF THE PREFERRED EMBODIMENTS

Hereinafter, a laser gun and a shooting system using the same of the present invention will be described below in detail with reference to the attached drawings.

Figure 1:
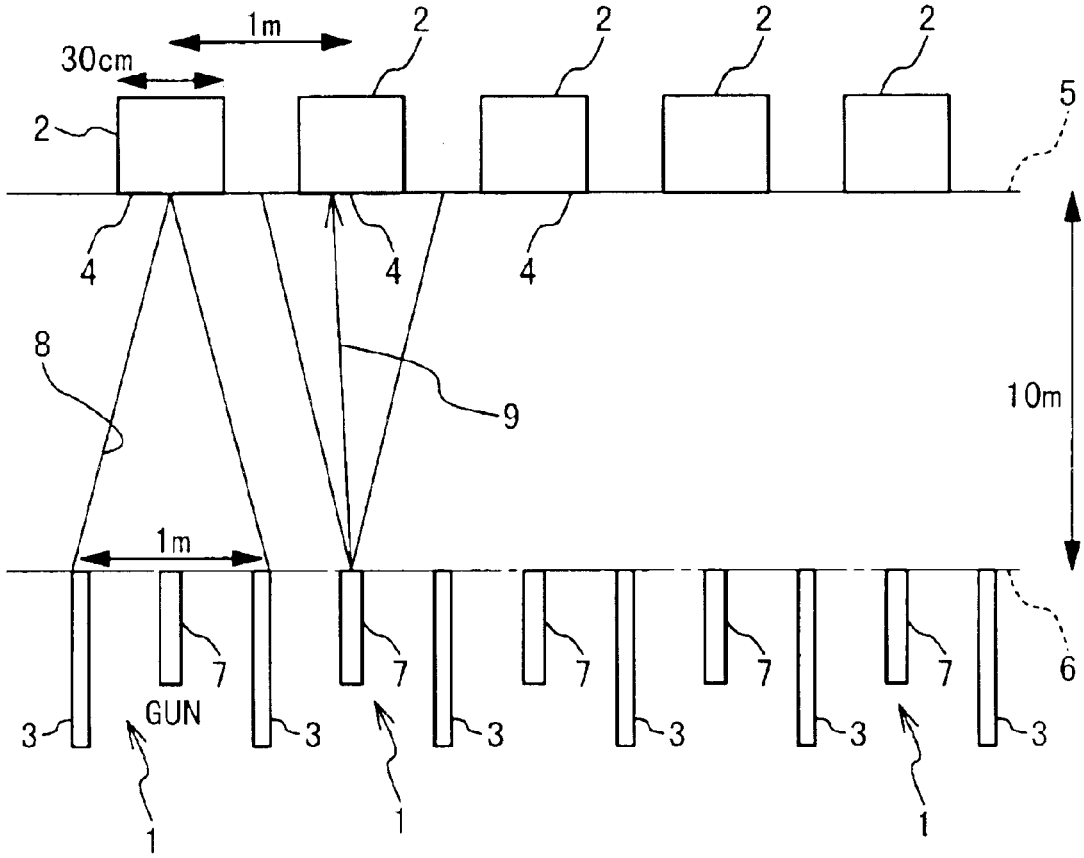
FIG. 1 shows a layout of a plurality of shooting boxes and a plurality of shot position detectors in a shooting system using laser guns according to a first embodiment of the present invention.

FIG. 1 shows a layout of a plurality of shooting boxes and a plurality of shot position detectors 2 in the shooting system using the laser guns according to the first embodiment of the present invention. In FIG. 1, one gun corresponds to one target. Referring to FIG. 1, the number of shooting boxes 1 is exemplified as five, and the number of shot position detectors 2 is also exemplified as five. That is, the shot position detector 2 is provided for each of the plurality of shooting boxes 1. In this example, there is no case that laser beam bullets are emitted from one shooting box 1 to the plurality of shot position detectors 2. Even if there is such a case, the laser beam bullet is not detected or is invalidated, as will be described later.

Each of the shooting boxes 1 is partitioned by two partitions 3. A common shooting allowable plane 6 is formed for a plurality of shooting boxes 1. On the common shooting allowable plane 6, the lateral width of one shooting box 1 is 1 m in the case of one gun to one target, and may be defined variably in cases of one gun to a plurality of targets. A laser gun 7 is used to shoot a laser beam bullet in the shooting box 1.

Each of the shot position detector 2 detects a position shot with a laser beam bullet. A square or circular target plate 4 is fixed to the front position of each shot position detector 2. The front surfaces of the plurality of target plates 4 form a common plane 5. The common plane 5 and the common shooting allowable plane 6 are parallel to each other and are both vertical. The distance of 10 m or 25 m is exemplified as the distance between the common plane 5 and the common shooting allowable plane 6, depending on the kind of shooting sport. The distance of 1 m is exemplified as the distance between center lines of every adjacent two shot position detectors 2. The laser gun 7 may be used freely between the adjacent two partition plates 3 based on shooting sport rules as long as the gun does not go over the common shooting allowable plane 6 toward the shot position detector 2.

The shot position detector 2 emits a conical beam 8 such as an optical conical beam, an optical elliptic conical beam, and a pyramidal beam generated from an infrared LED. Each of the optical conical beams 8 emitted from the five shot position detectors 2 reaches a corresponding shooting box 1, but does not principally reach two shooting boxes. The laser beam bullet 9 is emitted from the laser gun 7 to have a signal inherent to the laser gun 7. The laser beam bullet 9 has a high parallel flux characteristic and reaches a target plate 4 of the corresponding shot position detector 2 in form of an optical dot by a lens which will be described later.

The conical beam 8 includes a laser emission permission signal and is received by a light receiving section of the laser gun 7. The pulse width of the conical beam 8 is inherent to the shot position detector 2 and adjacent conical beams have pulse widths different from each other.

Figure 2:
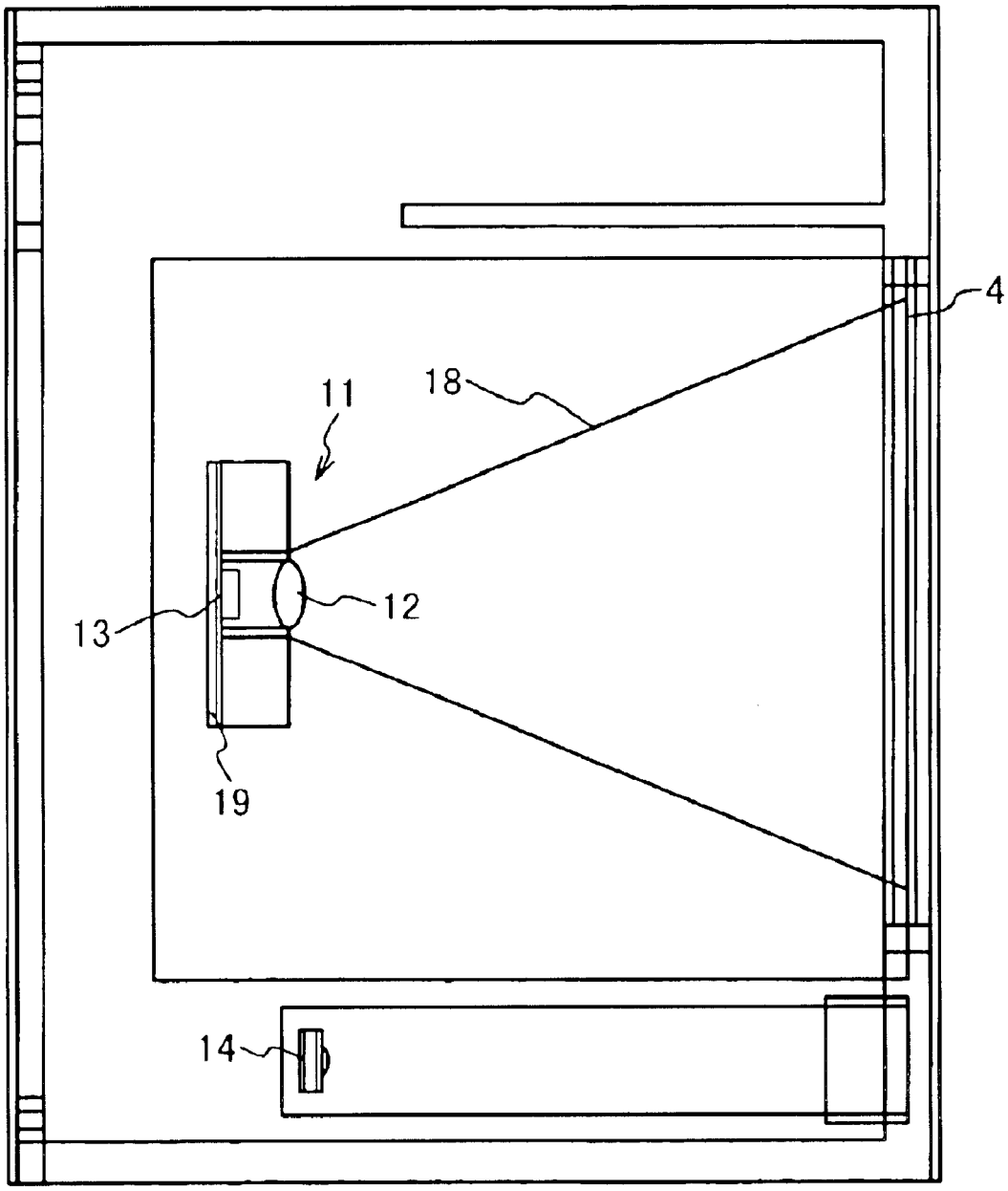
FIG. 2 is a side cross-sectional view showing the shot position detector.

FIG. 2 shows a side cross sectional view of the shot position detector 2. A casing and inner support structure of the shot position detector 2 are designed and assembled to achieve high rigidity, so that the magnitude of thermal distortion can be restricted within an allowable range. The shot position detector 2 is comprised of a position detection optical element 11 in addition to the target plate 4. The position detection optical element 11 is comprised of a convergence lens 12 and a position detection semiconductor element 13. A charge coupled device (CCD device) or photo-sensing device (PSD device) is known as the position detection semiconductor element 13. In this example, the PSD device 13 is preferably used as the position detection semiconductor element 13 in view of cost and detection speed. The shot position detector 2 is further comprised of an infrared LED 14.

The PSD device 13 has a two-dimensional current generation film. When the two-dimensional current generation film is shot with the laser beam bullet converged by the target plate 4 and the convergence lens 12, the PSD device 13 generates currents Ix1 and Ix2 in opposite directions of the x-axis direction, and also generates currents Iy1 and Iy2 in opposite directions of the y-axis direction. The coordinates (x, y) of a beam point as a position shot with the laser beam bullet are expressed by the following expression:

$$x=k(Ix2-Ix1)/(Ix2+Ix1)$$

$$y=k(Iy2-Iy1)/(Iy2+Iy1) \quad (1)$$

Thus, the beam point coordinates (x, y) can be calculated and determined. The beam point where (Ix2−Ix1) and (Iy2−Iy1) are both zero is determined as a mechanical coordinate origin (0, 0) of the PSD device 13. The mechanical coordinate origin is a position where the coordinate values defined as described above become zero, and are the electrical center point of the PSD device 13. The mechanical coordinate origin is fixed on the casing structure of the shot position detector 2. The target plate 4 is positioned two-dimensionally with a precision within an allowable range defined with respect to the PSD device 13.

The target plate 4 has a light-scattering transmittable film. The laser beam bullet 9 from the laser gun 1 reaches the target plate 4 and a substantially circular image having the diameter of about 1 mm is formed on the light-scattering transmitting film. The substantially circular image is converged by the convergence lens 12 and is formed as a dot-like real beam image on the two-dimensional current generation film of the PSD device 13. In order that the values of four currents generated by the PSD device 13 respectively exceed threshold values, the light amount of the laser beam received by the PSD device 13 must be larger than the threshold values. For this purpose, the width of the light pulse to be described later must be larger than a certain width. However, increasing this width means that the period from the beam bullet arrival to position detection of the shot position with the laser beam bullet is elongated.

The infrared LED 14 of the shot position detector 2 is advantageous in view of cost. However, an LED suitable for a long distance transmission has a slow generation speed, while an LED having a fast generation speed is not suitable for the long distance transmission. Taken these characteristics into account, a plurality of LEDs may be used for the long distance transmission of 25 m. Use of the plurality of LEDs appears as if the generation speed is fast.

An infrared transmitting window formation slit 15 is fixed to a front portion of the casing of the shot position detector 2, and has a vertically elongated elliptic shape. Thus, the position of the slit can be adjusted freely. The infrared transmitting window formation slit 15 is detachable from the shot position detector 2. It is preferable that a plurality of infrared transmitting window formation slits 15 are detachable and one of the slits 15 is selected in accordance with the kind of shooting sport. In case of providing a plurality of shooting boxes, modifications may be freely made so that the infrared transmitting window formation slits 15 can be shifted horizontally on the virtual plane where the slits 15 are set, and can be fixed to the casing of the shot position detectors 2 at a plurality of positions.

Figure 4:
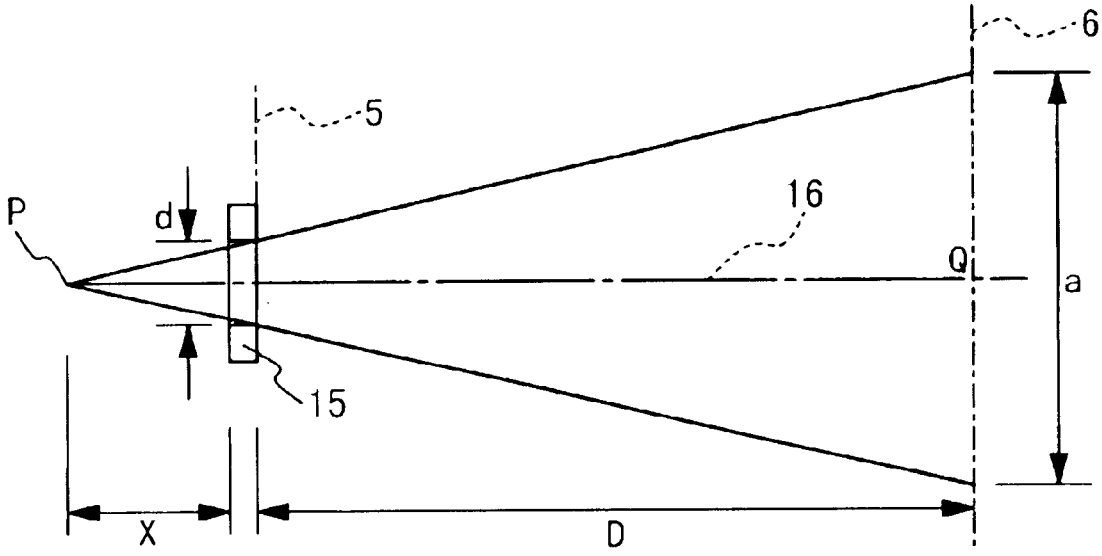
FIG. 4 is a diagram showing the emission of an infrared light from an infrared LED.

An emission region of the infrared LED 14 which emits the optical conical beam 8 is not a point region but is a multi-point region. By providing a lens system (not shown) in front of the infrared LED 14, the emission region of the infrared LED 14 can be treated not as a multi-point region but as single-point region. FIG. 4 shows the emission of the infrared LED 14. Referring to FIG. 4, the point region is represented by the point P. The center line of the light beam from the infrared LED 14 as an infrared optical axis includes the crosses the point P, crosses the common plane 5 at right angle, and crosses the common shooting allowable plane 6 at a point Q. The horizontal width of the infrared transmitting window slit 15 is indicated by "d". The distance between the slit and the common shooting allowable plane 6 is indicated by D. The distance between the point P and the common plane 5 is indicated by "X". The horizontal width of the shooting box 1 is indicated by "a". Although the slit width d differs depending on the angular positional relationship between a specified shot position detector 2 and a specified shooting box 1, the slit width d is geometrical-optically expressed based on proportional relationship by the following expression according to excellent approximation.

$$a/2(X+D)=d/2X$$

Hence obtained is:

$$d=aX/(X+D) \quad (2)$$

In the above equation (2), "a" and "D" are predetermined values, and "X" is a design value. From the equation (2), the slit width d of the infrared transmitting window slit 15 is determined. The width of the infrared transmitting window formation slit 15 in the height direction is determined with reference to the height position of the hand of a shooter who extends his arm at the time of shooting, or the height position of a gun barrel body when the shooter sets a gun stock part on his shoulder and looks into a gun sight to fit the sight line to the target.

Figure 3:
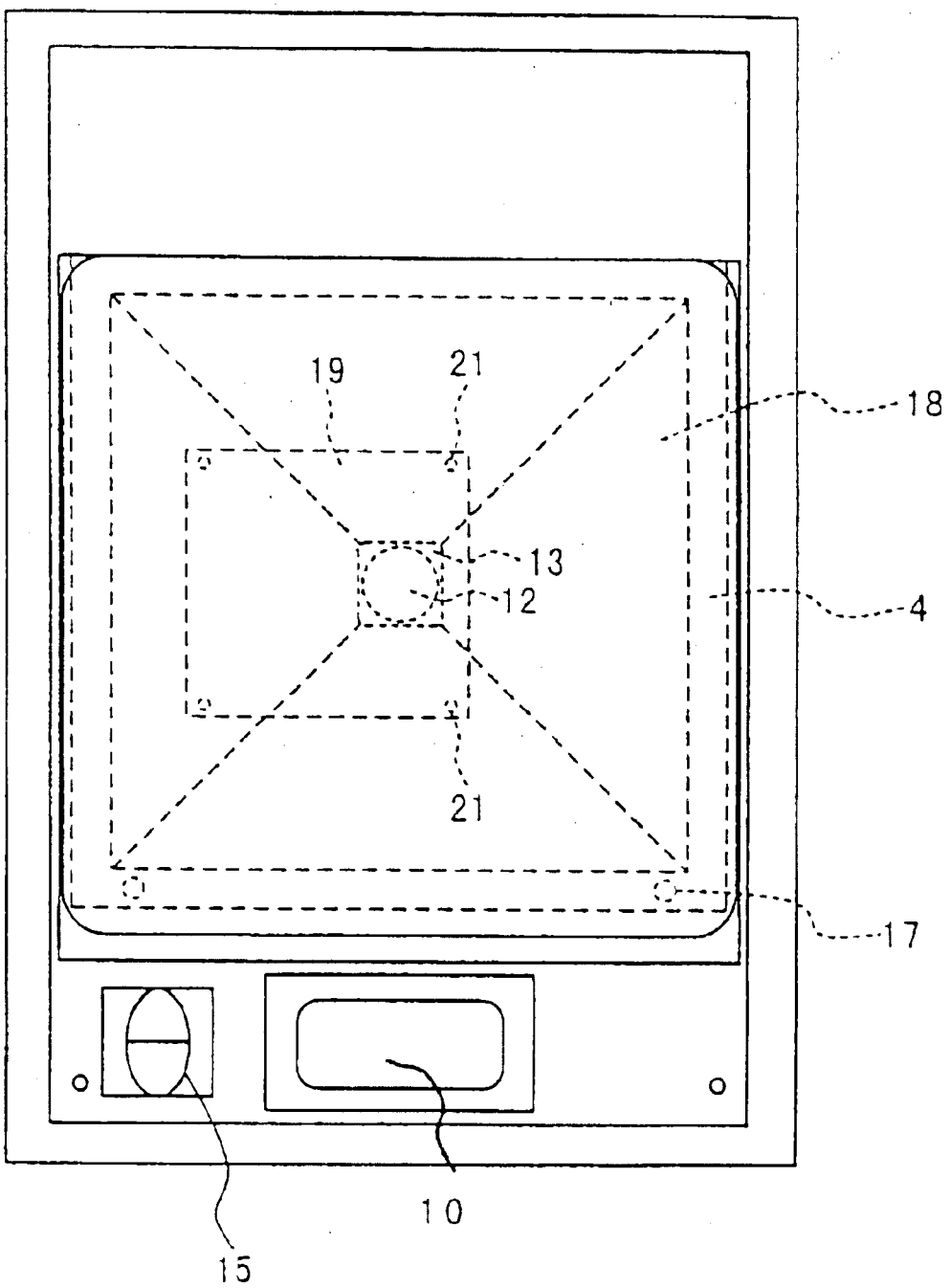
FIG. 3 is a front view showing the shot position detector.

FIG. 3 is a front view of the shot position detector 2. Referring to FIG. 3, positioning holes 17 are provided in the front portion of the shot position detector 2 at a plurality of positions on the target plate 4. The positioning holes 17 are used for positioning of the target plate 4 with high precision in the three-dimensional coordinate system defined based on the above-mentioned mechanical coordinate origin of the shot position detector 2. Although the target plate 4 is replaced depending on a kind of shooting sport, a replaced new target plate 4 can be constantly positioned to be strictly adjustable three-dimensionally with respect to the mechanical coordinate origin of the PSD device 13, by inserting pins into the positioning holes 17 of both sides.

A conical cover 18 is attached between the target plate 4 and the convergence lens 12. The conical cover 18 forms a dark box to prevent scattering light scattered by the target plate 4 from entering into the convergence lens 12 as stray light. The convergence lens 12 and the PSD device 13 are attached to an attachment board 19. The attachment board 19 is attached securely with high rigidity to a casing portion of the shot position detector 2 by bolts 21, as shown in FIG. 3. The shot position detector 2 includes internally a air-cooling window and various electronic circuit units which will be described later, and is set on a base (not shown) which is strongly secured, such that the target center point of the target plate 4 is set to a defined height position.

Figure 5:
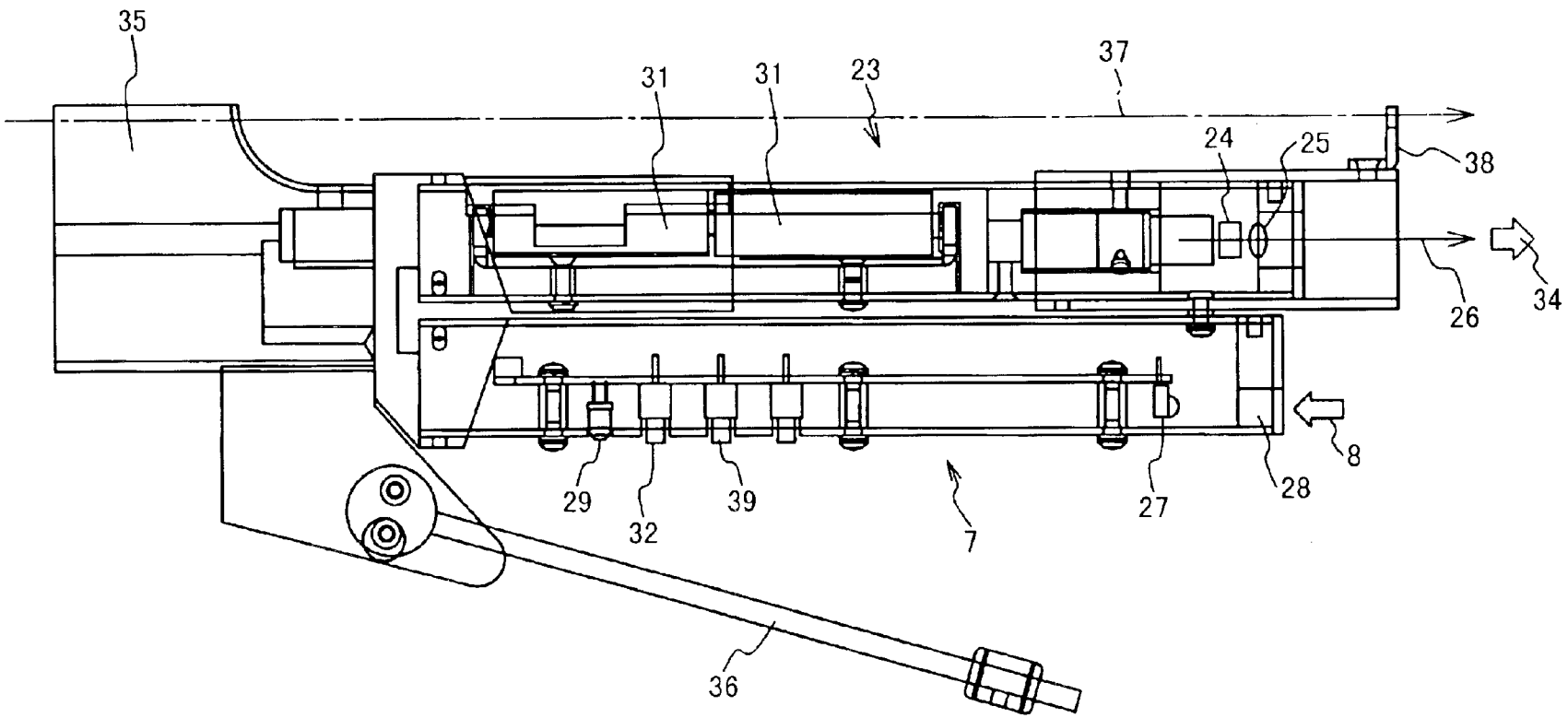
FIG. 5 is a side cross-sectional view showing a gun barrel body portion of the laser gun.

FIG. 5 shows a gun barrel body portion 23 of the laser gun 7, although a grip portion of the gun is omitted. A semiconductor laser oscillation element 24 is used as a light source for a visible light or infrared light. A beam adjuster lens 25 is provided to unify multiple light emission points generated by the semiconductor laser oscillation element 24 and to give a proper beam diameter at the distance of 10 m. The beam adjuster lens 25 is provided coaxially on an optical axis 26 of the semiconductor laser oscillation element 24.

A photo-diode 27 is provided at a lower portion of the front portion of the gun barrel body portion 23. The photo-diode 27 receives a part of the conical beam 8 emitted from the infrared LED 14 of the shot position detector 2 through an infrared reception port 28 opened in a front end portion of the gun barrel body portion 23. A shooting state indication LED 29 is provided and exposed in a lower surface portion of the gun barrel body portion 23. Plural batteries 31 are contained in an upper portion (upper half region) of the gun barrel body portion 23 so that they may be replaced with ease. The center of gravity of the gun barrel main body 23 is adjusted by means of a stabilizer 36. A power ON/OFF switch 32 is provided at the lower surface portion of the gun barrel body portion 23. The shooting state indication LED 29 is lit on continuously in accordance with an ON operation the power ON/OFF switch 32. The shooting state indication LED 29 may emit blinking or continuous light, when a laser emission permission signal 53 of the conical beam 8 is received by the photo-diode 27. The color of continuous light of the shooting state indication LED 29 is preferably changed to a cold color so that the shooter might not get distracted. As the shooter pulls a trigger (not shown), the semiconductor laser oscillation element 24 emits a laser beam bullet 34 including a light beam bullet signal 33 defined by a control circuit to be described later, along the optical axis 26. A stabilizer 36 is rotatably attached to the gun barrel body portion 23 and can be fixed at an arbitrary rotation position. The naked-eye optical axis 37 of the shooter runs toward a target, passing a cross-point of a cross-line sight 38 attached to the upper end surface portion of front portion of the gun barrel body portion 23.

Three operation modes of the laser gun 7 are prepared depending on trigger operations.

The first mode is a real shooting mode in which the laser beam bullet 34 including the light beam bullet signal 33 inherent to the laser gun 7 is actually emitted only in case of receiving a part of the conical beam 8 through the infrared reception port 28.

The second mode is a test shooting mode in which the laser beam bullet including the light beam bullet signal 33 and an invalidation signal for invalidating the laser beam bullet is actually emitted only in case of receiving a part of the conical beam 8 through the infrared reception port 28. The invalidation signal may be realized as a signal in which a validation signal is not contained in the laser beam bullet, or as a signal in which said laser beam bullet contains a modification of the validation signal. For example, to achieve such invalidation, a signal 75-1-1 which will be described later with reference to FIG. 9C may be set to "00". Alternatively, a signal 75-1-2 may be changed to "000000". The laser beam bullet can be easily treated as an invalid live bullet in replace of a valid live bullet. By using this kind of signal, the laser beam bullet in the second mode can be distinguished from the laser beam bullet in the first mode.

The third mode is a touch-sense check mode in which an operation of pulling the trigger is only checked and no live bullet is emitted. Thus, the safety can be secured.

Figure 6:
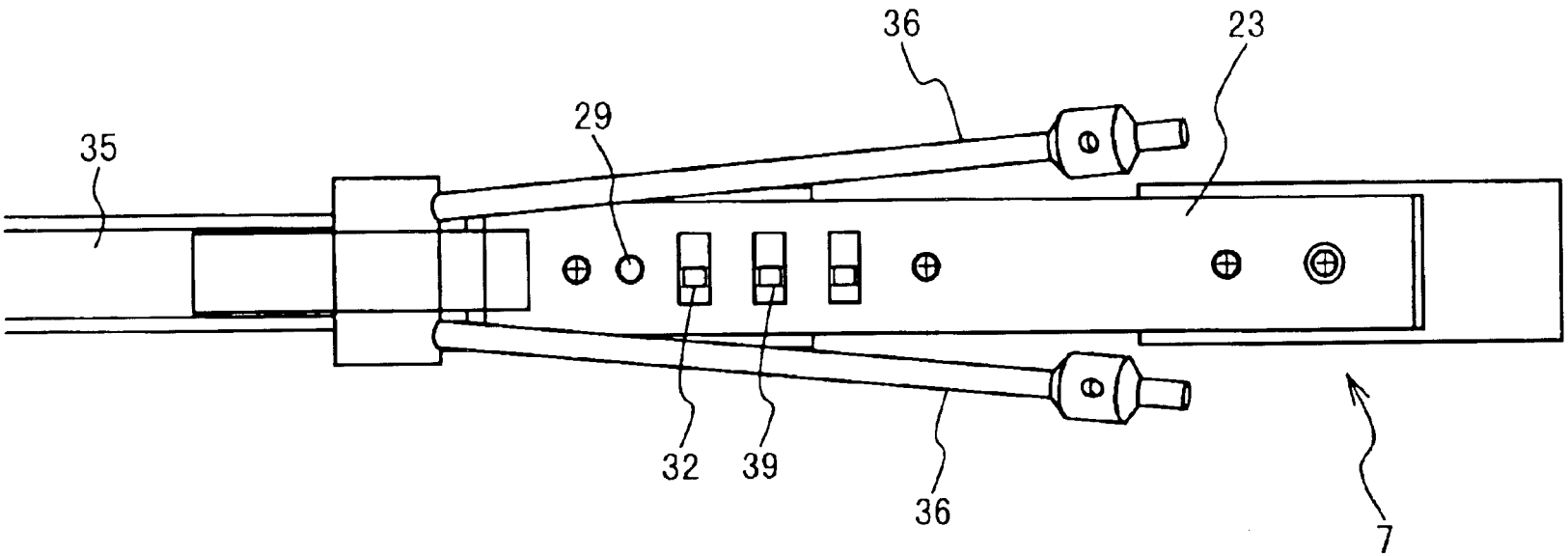
FIG. 6 is a plan view showing a lower surface portion of the gun barrel body portion.

The selection between the real shooting mode and the test shooting mode is made by shifting the position of a mode selection switch 39 provided at the lower surface portion of the gun barrel body portion 23, as shown in FIG. 6. Adoption of this kind of slide switch allows the shooter to check the mode selection position of the switch. It is preferable that the switches and lamps should be positioned in upper and lower opposite sides in the direction vertical to the naked-eye optical axis 37. In particular, the switches should be more preferably positioned in the lower side. Also, it is preferable that any conspicuous objects, especially lamps, should not exist near the naked-eye optical axis 37.

Figure 7:
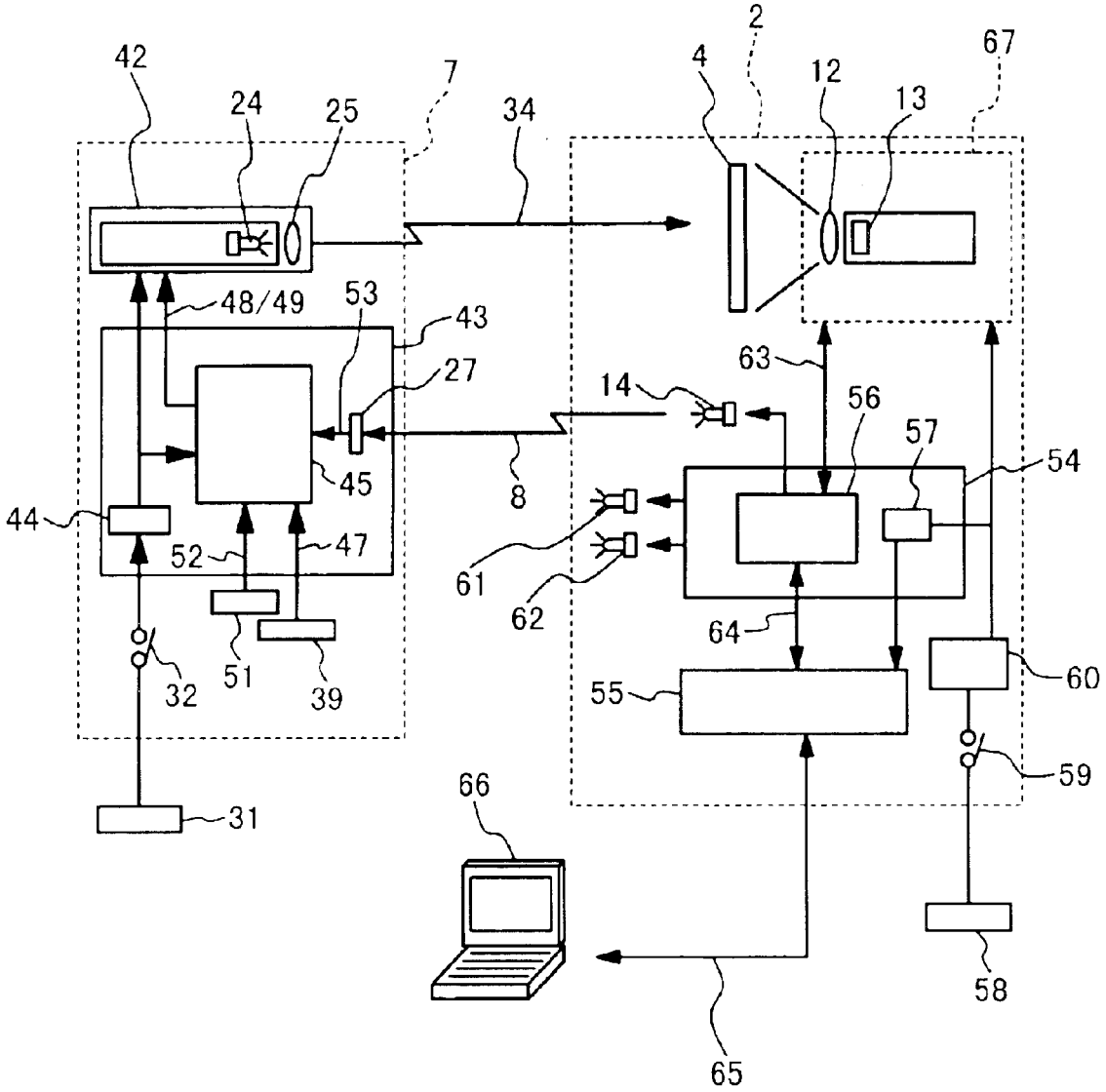
FIG. 7 is a block diagram showing a shooting system for a laser gun according to a first embodiment of the present invention.

FIG. 7 shows a shooting system using the laser gun according to the first embodiment of the present invention. The present system is comprised of the laser gun 7 and the shot position detector 2 as described previously. The shot position detector 2 executes bi-directional communication by means of the conical beam 8 and the laser beam bullet 34 from the laser gun 7. The laser gun 7 is comprised of a laser diode (LD) unit 42 and an LD board 43. The laser diode unit 42 is comprised of the semiconductor laser oscillation element 24 and the beam adjust lens 25.

The power from the battery 31 of the laser gun 7 is supplied to the LD unit 42 through the LD board 43 and the power ON/OFF switch 32. The LD board 43 is comprised of a direct current/direct current (D/D) converter 44 and a light beam bullet signal output control unit 45. The direct current power from the battery 31 is supplied to the light beam bullet signal output control unit 45 and the LD unit 42 through the D/D converter 44. The mode selection switch 39 generates the mode selection signal 47 based on the operation of it. The mode selection signal 47 is supplied to the light beam bullet signal output control unit 45. The laser beam bullet output control unit 45 outputs to the LD unit 42, a first laser generation current 48 in the real shooting mode or a second laser generation current 49 in the test shooting mode. The LD unit 42 outputs the laser beam bullets in accordance with the first laser generation current 48 and the second laser generation current 49. The first laser generation current 48 or the second laser generation current 49 is not generated if an electric trigger signal 52 is not supplied to the laser beam bullet signal output control unit 45. The electric trigger signal 52 is outputted from the trigger signal generator 51 upon pulling of a trigger. In addition, the first laser generation current 48 or the second laser generation current 49 is not generated if the laser emission permission signal 53 generated upon reception of the conical beam 8 is not supplied to the laser beam bullet signal output control unit 45. Accordingly, the laser beam bullet is not emitted from any laser gun 7 that is not situated in the shooting box 1, so that security for safety can be attained.

The shot position detector 2 is comprised of the target plate 4, the photo-sensing diode (PSD) device 13, and the infrared LED 14. The shot position detector 2 is further comprised of a transmission/reception signal control section 54 and a system control CPU 55. The transmission/reception signal control section 54 has a transmission/reception signal control unit 56 and a D/D converter 57. The shot position detector 2 is connected to a public power source 58 through a switch 59. The power received from the public power source 58 is supplied to the D/D converter 57 and the PSD device 13 through an A/D power converter 60. A green shooting-allowance lamp 61 is turned on to indicate the shooting allowed state, and a red shooting-inhibition lamp 62 is turned on to indicate the shooting inhibited state. The lamps 61 and 62 are provided in the upper portion of the front wall of the shot position detector 2.

The laser beam bullet 34 including the laser beam bullet signal 33 is scattered by the target plate 4. The scattered light is converged onto the light receiving surface of the PSD device 13 through the convergence lens 12. The PSD device unit 67 including the PSD device 13 removes noise such as distrubances from the laser beam bullet 34, and amplifies a signal corresponding to the received laser beam bullet to output a current value signal 63 to the transmission/reception signal control unit 56. The current value signal 63 corresponds to the current values of the two pairs of currents in a two-dimensional direction. The current values are shown by the above-mentioned equation (1) with respect to a convergence point. The transmission/reception signal control unit 56 executes lightening control of the green shooting-allowance lamp 61, the lightening control of the red shooting-inhibition lamp 62, and the emission control of the infrared LED 14. The current value signal 63 is processed to generate a bullet arrival value signal 64, which is transmitted to the system control CPU 55. In particular, the system control CPU 55 executes score calculation and correction based on the bullet arrival state value 64, and controls a display 10 (as seen in FIG. 3) provided on the shot position detector 2. The score calculation and correction based on the bullet arrival state value 64 may be executed by a personal computer 66 connected to the system control CPU 55 through a LAN 65. In case where the score calculation and correction is executed by the system control CPU 55, the score count result is displayed directly on the display 10.

Figures 8A, 8B, 8C, 8D, 8E:
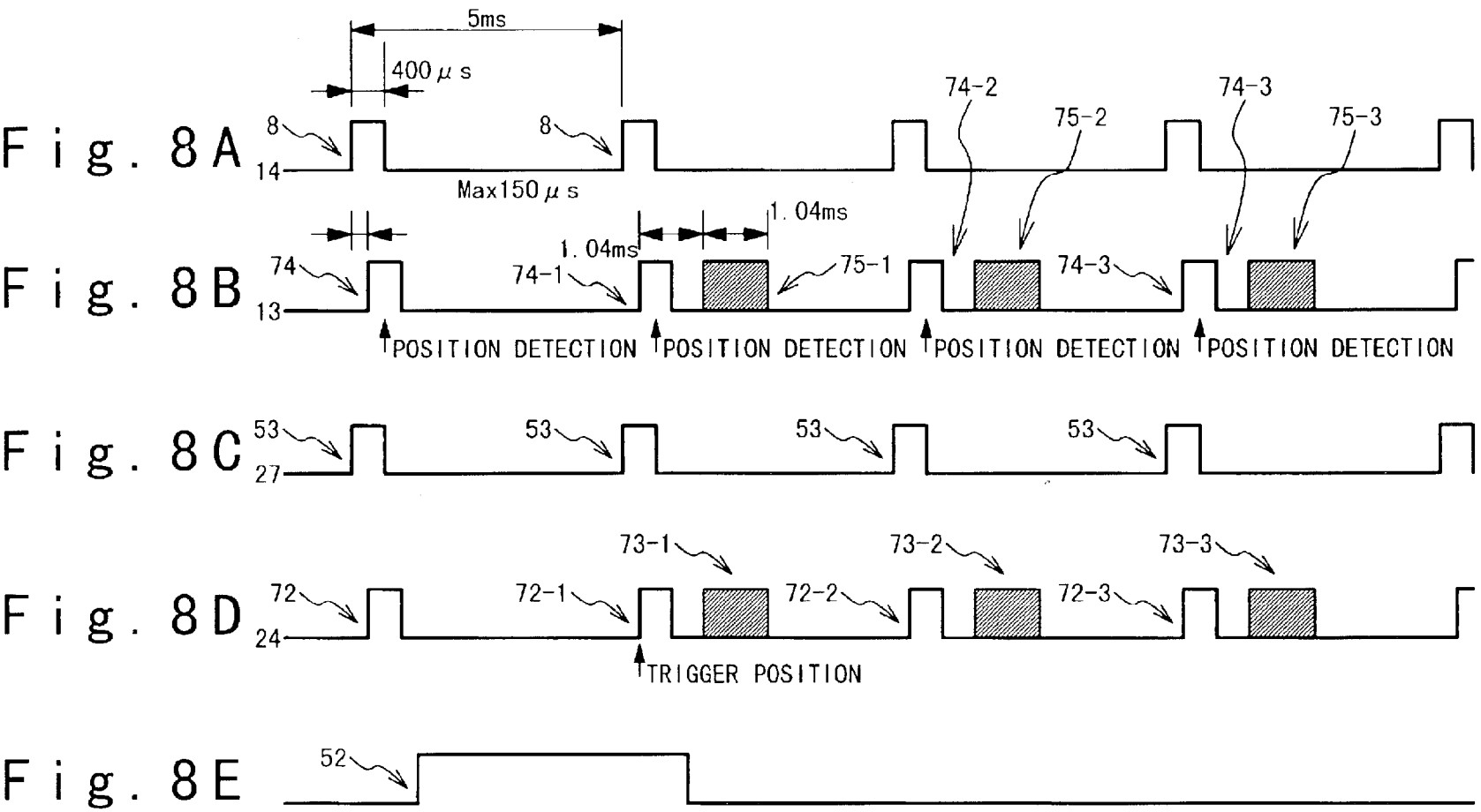
FIGS. 8A to 8E are timing charts showing a conical beam and various signals in the shooting system shown in FIG. 7.

FIGS. 8A to 8E show time sequences of the laser emission permission signal 53 and laser beam bullet signal 33. The shooter sets the mode selection switch 39 to select the real shooting mode or the test shooting mode, and brings the laser gun 7 into the shooting box 1. Particularly, when the shooter turns the muzzle of the gun 7 toward the target plate 4, the laser emission permission signal 53 of the conical beam 8 is received by the photo-diode 27 in the laser gun 7 regardless of the intension of the shooter. The conical beam 8 is emitted in a predetermined time interval of 5 ms from the shot position detector 2, as shown in FIG. 8A. Each time the laser emission permission signal 53 of the conical beam 8 shown in FIG. 8C is received, a bullet timing signal 72 is emitted. When the trigger is pulled, the laser beam bullet 34 including the bullet timing signal 72 is emitted from the LD unit 42. The bullet timing signal 72 is received by the PSD device 13 as a bullet timing signal 74 which is a bullet shot signal. The laser beam bullet 34 is emitted as a plurality of elementary laser beam bullets 73-1, 73-2, 73-3. The number of elementary laser beam bullets is predetermined. Each of the plurality of elementary laser beam bullets 73-1, 73-2, and 73-3 contains the bullet timing signal 72. The elementary laser beam bullets 73-1, 73-2, 73-3 are converted into the shot position detection value signals 64 by the PSD device unit 67 and the transmission/reception signal control unit 56 in synchronism with the bullet timing signals 74-1, 74-2, 74-3, and are then supplied to the system control CPU 55.

As described above, when the shooter operates the trigger (not shown) to generate the electric trigger signal 52, a laser beam bullet identification signal 73 as a bullet attribute signal corresponding to the bullet timing signal 72 is generated by the semiconductor laser oscillation element 24 and emitted from the laser gun 7. The laser beam bullet 34 in the real shooting mode or the test shooting mode is composed of the bullet timing signal 72 and the laser beam bullet identification signal 73. The PSD device 13 receives the bullet timing signal 72 and outputs the bullet timing signal 74 corresponding to the bullet timing signal 72, as shown in FIGS. 8B and 8D. Also, the PSD device 13 receives the bullet timing signal 72 and the laser beam bullet identification signal 73 and outputs the bullet timing signal 74 corresponding to the bullet timing signal 72 and a laser beam bullet distinguishing signal 75 corresponding to the laser beam bullet identification signal 73, as shown in FIGS. 8B and 8D. The bullet shot signal 74 as the bullet timing signal is converted into the bullet arrival value signal 64, which is supplied to the system control CPU 55.

As shown in FIGS. 8D and 8E, three laser beam bullet identification signals 73 (73-1, 73-2, 73-3) are emitted based on a single trigger operation. The laser beam bullet identification signal 73-1 is emitted in response to a bullet timing signal 72-1. Another laser beam bullet identification signal 73-2 is emitted in response to another bullet timing signal 72-2. Further another laser beam bullet identification signal 73-3 is emitted in response to further another bullet timing signal 72-3. Thus, based on the single trigger operation, the laser beam bullet identification signals 73 are emitted three times.

The PSD device as a position detection semiconductor element 13 receives the three sets of signals 72 and 73 and outputs a set of the bullet shot signal 74-1 and a laser beam bullet distinguishing signal 75-1 in response to a first one of the three sets, a set of another bullet shot signal 74-2 and another laser beam bullet distinguishing signal 75-2 in response to a second one of the three sets, and a set of another bullet shot signal 74-3 and another laser beam bullet distinguishing signal 75-3 in response to a third one of the three sets. The three signals 75-1, 75-2, and 75-3 constitute one laser beam bullet group.

Figures 9A, 9B, 9C, 9D, 9E:
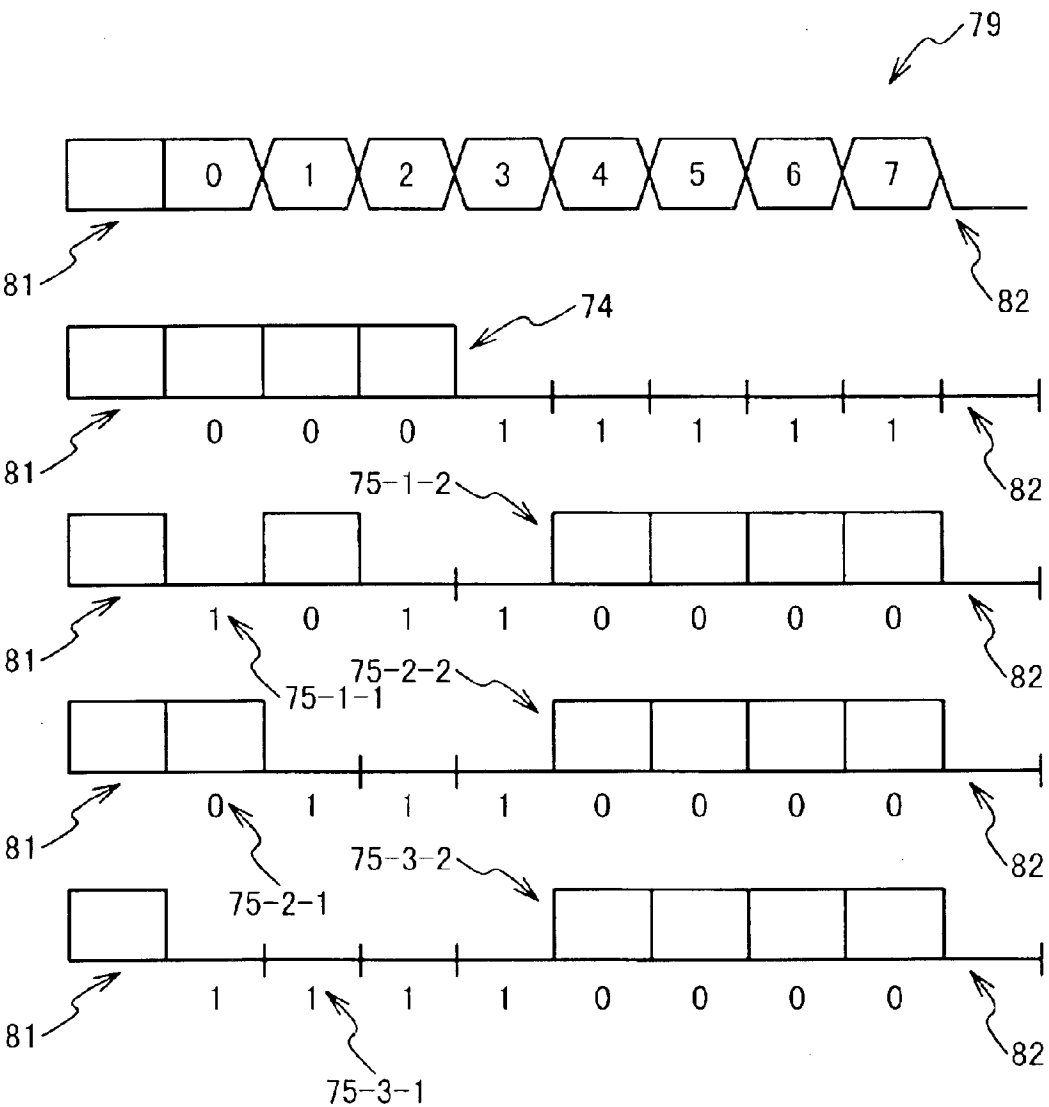
FIGS. 9A to 9E are bit charts respectively showing signals of a laser beam bullet.
Figures 10A, 10B, 10C, 10D:
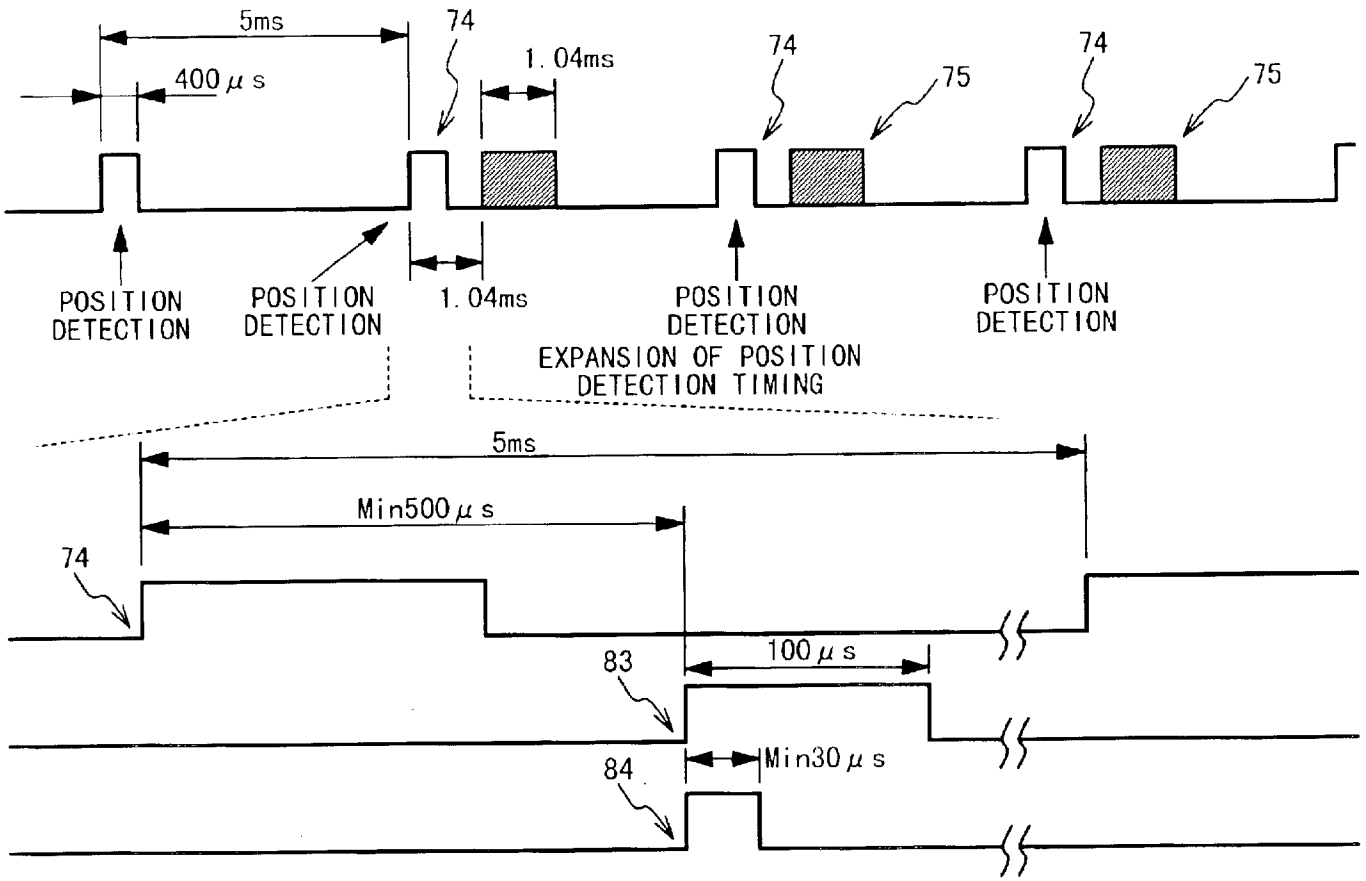
FIGS. 10A to 10D are timing charts showing a part of a signal shown in FIG. 8B.
Figures 11A, 11B, 11C, 11D, 11E:
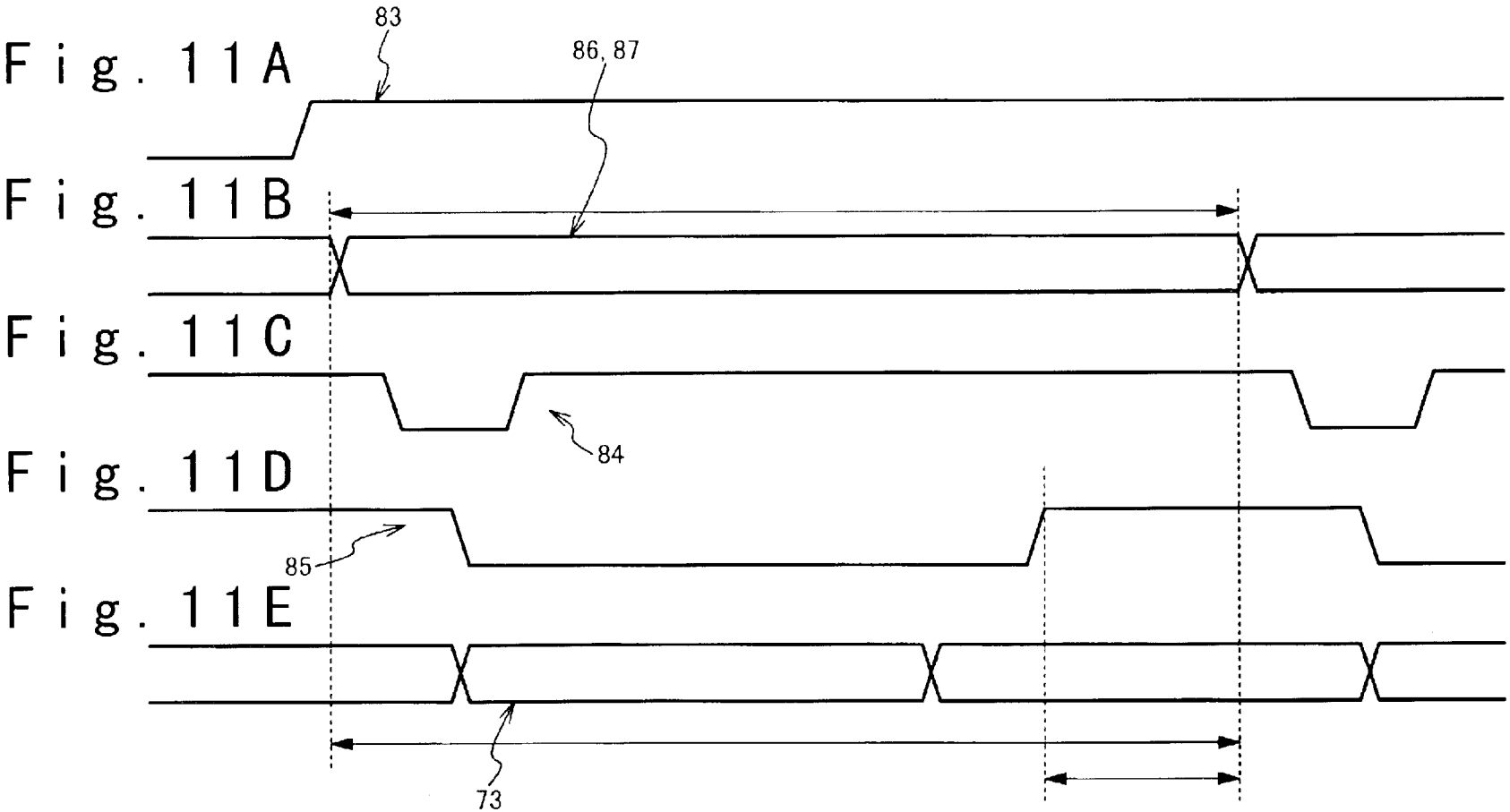
FIGS. 11A to 11E are timing charts showing data conversion.

FIG. 9A shows a structure of serial data 79 as a basic bit format of the shot position signal 74 and the laser beam bullet distinguishing signal 75. The top bit 81 of the serial data 79 is a start bit. The last bit 82 of the serial data 79 is a stop bit. FIG. 9B shows a bit format of the bullet shot signal 74. Eight bits between the top bit 81 and the last bit 82 are expressed as (0, 0, 0, 1, 1, 1, 1, 1). Four bits composed of the start bit and three active bits are supplied with at least a pulse width of 400 $\mu$s in consideration of the output performances of the infrared LED 14 and the photo-diode 27.

FIGS. 9C, 9D, and 9E show bit formats of the laser beam bullet distinguishing signal 75. The laser beam bullet distinguishing signal 75 is comprised of a first in-group laser beam bullet signal 75-1, a second in-group laser beam bullet signal 75-2, and a third in-group laser beam bullet signal 75-3. Two bits on the side of the top side among eight bits between the top bit 81 and the last bit 82 in each in-group laser beam bullet signal 75 are an in-group identification signal, which is expressed as "1", "2", or "3" and is used to identify either of in-group elementary laser beam bullet distinguishing signals 75-1, 75-2, and 75-3. In order to distinguish the signal 74 and the signal 75 in case where both signals are serialized, time-based order relationship between a first in-group laser beam bullet signal 75-1-1 and a first common signal 75-1-2 should preferably be reversed, although the relationship will be described later. Of the eight bits between the top bit 81 and the last bit 82, six bits from the side of the last bit indicates an emission order identification number of the laser beam bullet 34, and corresponds to the number of times of triggering operation. In one unit game, it is possible to emit laser beam bullets less than 63. Before starting the shooting operation, the six bits are initialized to (0, 0, 0, 0, 0, 0). In one game, the trigger can be pulled 63 times as expressed by (32+16+8+4+2+1) (=(64−1)), so that 63 laser beam bullets 34 can be shot. FIGS. 9C to 9E illustrate the bullet number is "110000" and exemplifies the third laser beam bullet 34. The bullet timing signal 74 shown in FIG. 9B has a total pulse width of 400 s, and the first and second laser beam bullet signals 75-1 and 75-2 of the laser beam bullet group shown in FIGS. 9C and 9D have a total pulse width of 600 s, whereas a trigger character signal 75-3 shown in FIG. 9E has a total pulse width of 400 s. In this case, the first and second laser beam bullet signals 75-1 and 75-2 may be used for the game and the trigger character signal 75-3 may be used for adjustment of the trigger operation. For the illustrated bullet number, 0 is used as active signal and 1 is used as passive signal. Its binary value is "110000", and the bullet number of the three laser beam bullets is commonly calculated by (2+1) and hence equal to 3.

As shown in the above, the first in-group laser beam bullet signal 75-1 is comprised of a first bullet in-group signal 75-1-1 indicating the first one of one identical laser beam bullet group, and a first common signal 75-1-2 indicating commonness to the laser beam bullet group. The second in-group laser beam bullet signal 75-2 is comprised of a second bullet in-group signal 75-2-1 indicating the second one of the laser beam bullet group, and a second common signal 75-2-2 indicating commonness to the laser beam bullet group. The third in-group laser beam bullet signal 75-1 is comprised of a first bullet in-group signal 75-3-1 indicating the third one of the laser beam bullet group, and a third common signal 75-3-2 indicating commonness to the laser beam bullet group. In general, a j-th in-group laser beam bullet signal 75-j is comprised of a j-th bullet in-group signal 75-j-1 indicating the j-th one of the laser beam bullet group, and a j-th common signal 75-j-2 indicating commonness to the laser beam bullet group. The common number of the first common signal 75-1-2 is equal to the common signal of the second common signal 75-2-2.

As will be described later, when the trigger is pulled once, a plurality of elementary laser beam bullets are emitted in response to the one trigger-pulling operation. This emission is like a machine-gun, but is different from a machine-gun in that a plurality of laser beam bullets are emitted upon the single instant triggering operation. As will be described later, a gun of a different type from conventional live-bullet shooting guns is realized.

The first bullet in-group signal 75-1-1, the second bullet in-group signal 75-2-1, and the third bullet in-group signal 75-3-1 are expressed by two bits. The first common signal 75-1-2, the second common signal 75-2-2, and the third common signal 75-3-2 are expressed by six bits.

The plurality of bullets for the bullet timing signal 74 in common diversifies shooting sports. Due to the diversification, the score can be calculated as one score with respect to one common number based on the first bullet in-group signal 75-1-1 and the second bullet in-group signal 75-2-1. Further, the score can be calculated by averaging a score based on the first bullet in-group signal 75-1-1 and a score based on the second bullet in-group signal 75-2-1. A fine relative fluctuation between the fingers of the shooter and the gun barrel after a triggering operation is reflected on the score. A trace is drawn between the shot position of the first bullet arrival signal 74-1 and that of the second bullet arrival signal 74-2. If the relative fluctuation is large, the score is low. Alternatively, if the relative fluctuation is small, the score is high.

Due to the fluctuation of the optical system or the gun, the three bullets are not guaranteed to arrive one same point, so the scores thereof are not always equal. An average value of three coordinate values of the three bullets is calculated by the system control CPU 55 or the personal computer 66. A score corresponding to the average value is calculated by the system control CPU 55.

The number of elementary bullets may be more. In this case, the score is obtained in compliance with the relative positional relationship between the shot position of the first bullet arrival signal 74-1 and that of the second bullet arrival signal 74-2. The first bullet arrival signal 74-1 and the second bullet arrival signal 74-2 are representatives among more bullet arrival signals.

The shot positions of the plurality of laser beam bullets may be traced as a sequence of points. This trace is displayed in the shooting sport field on a display separated from the target plate 4. Properties of shot positions such as a size of an area indicating aggregation of sequences of shot positions, an averaged distance from an origin (i.e., the target center), and a spread of angular distributions about the origin, can express strictly and variously the relative motions of the shooter's fingers and gun barrel. This kind of shooting sport cannot be realized by conventional live-bullet shooting competitions.

If the trigger is not operated, the bullet timing signals 74 (74-1, 74-2, and 74-3) are sequentially received by the target plate 4 as long as the muzzle of the laser gun 7 is oriented toward the target plate 4. The trace of the bullet timing signals 74 corresponding to the shot the bullet timing signals 72 is displayed on the display. This kind of trace indicates the fluctuation of the shooter. The shooter can pull the trigger, watching the fluctuation of the trace displayed on a display surface such as a screen provided near. Projecting this kind of trace onto a large-size screen can enrich services for audience.

FIGS. 10A to 10D show data detection timings. The single bullet timing signal 74 is enlarged and shown in FIGS. 10B to 10D. A data conversion cycle allowance signal 83 is delayed by a predetermined time from the falling edge of the bullet timing signal 74. Before the next bullet timing signal 74 is outputted, a data conversion cycle signal 84 is generated in synchronization with the rising edge of the data conversion cycle allowance signal 83. The bullet arrival position coordinate data (x, y) is interpreted in synchronization with the data conversion cycle signal 84. The shot position coordinate data (x, y) is included in the current value signal 63. The coordinate position (x, y) of the shot position is calculated in accordance with the above equation (1) by the system control CPU 55 or the personal computer 66. The shot position coordinate data (x, y) is transmitted to the personal computer 66 and is stored into a memory section of the personal computer 66. Further, the data is displayed on the screen of a display unit (not shown) in the shooting sport field on real-time. The shot position coordinate data is used for scoring when the elementary laser beam bullet is inputted.

FIGS. 11A to 11E show data interpretation timings. If the data conversion cycle allowance signal 83 is supplied to the control unit 56, the data conversion cycle signal 84 is generated by the control unit 56. A BUSY signal 85 supplied to the control unit 56 falls to "L" to stop the output of the infrared LED 14. A first conversion data selection signal 86 and a second conversion data selection signal 87 are generated from the transmission/reception signal control unit 56 and multiplexed. There are four combinations of the first conversion data selection signal 86 and the second conversion data selection signal 87, expressed by (0, 0), (0, 1), (1, 0), and (1, 1).

If the combination is (0, 0), the shot position coordinate data (x, y) is treated as a trace of the gun muzzle direction to the target. If the combination is (0, 1), a signal corresponding to the x-coordinate value of the shot position coordinate data (x, y) is transmitted to the control unit 56. If the combination is (1, 0), a signal corresponding to the y-coordinate value is transmitted to the control unit 56. If the combination is (1, 1), signals corresponding to the x- and y-coordinate values are transmitted to the control unit 56. After the data conversion of converting the shot position coordinate data (x, y) into coordinate values is completed, the BUSY signal 85 recovers the status of "H".

Figure 12:
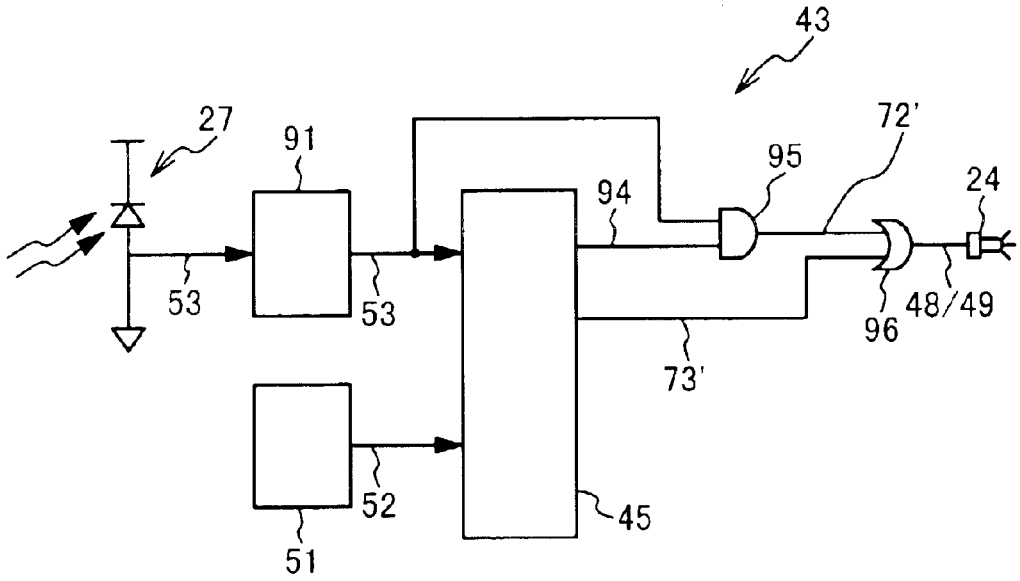
FIG. 12 is a circuit block diagram showing a laser beam bullet generation circuit in the laser gun.

FIG. 12 shows a laser beam bullet generation circuit 43 which generates the bullet timing signal 72 and the laser beam bullet identification signal 73 of the laser beam bullet 34 outputted from the laser gun 7. The laser beam bullet generation circuit 88 is comprised of an amplifier 91, and the trigger signal generation circuit 51. The amplifier 91 amplifies the output signal from the photo-diode 27 to generate a synchronization signal 53. The trigger signal generation circuit 93 generates the trigger signal 52 based on an operation of pulling the trigger. The light beam bullet signal output control unit 45 receives the synchronization signal 53 and outputs the laser oscillation current 94. The synchronization signal 53 and the laser oscillation current 94 are supplied to an AND gate as a synchronization output element 95. A part of the laser oscillation current 94 is outputted as a laser beam bullet corresponding power 72' corresponding to the bullet timing signal 72 for a time width corresponding to the pulse width of the synchronization signal 53.

Based on the trigger signal 52, a laser beam bullet corresponding power corresponding to the laser beam bullet distinguishing signal 73 is generated by the laser beam bullet signal output control unit 45. The laser beam bullet corresponding powers are supplied to an OR gate as a synchronous delay element 96. Based on the output from the synchronous delay element 96, the semiconductor laser oscillation element 24 outputs the laser beam bullet 34 including the bullet timing signal 72 and the laser beam bullet distinguishing signal 73.

Figure 13:
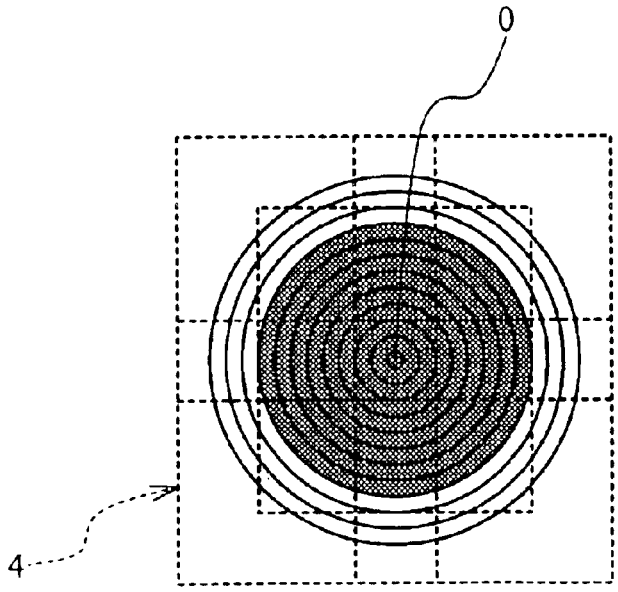
FIG. 13 is a front view showing a target plate in the shooting system.

FIG. 13 shows details of the target plate 4. In the target plate 4, the scoring region is divided into ten regions expressed by ten concentric circles. The outermost ring region gives a score of 1 point. The central circular region gives a score of 10 points. A plurality of target plates 4 are prepared. As has been explained previously, the target plates 4 to be assembled can be attached in a replaceable manner by inserting pins into the positioning holes 17.

Although the geometrical precision of the circles of the target plate 4 is sufficiently high in relation to the precision of skills of shooters, the PSD device 13 has insufficient electric, mechanical, and optical precision. Therefore, it is important that the geometrical positional precision of the convergence lens 12 relative to the PSD device 13, mechanical precision in assembly of the convergence lens 12 and the PSD device, and the electric precision in the electric symmetry based on the distortion of the PSD device 13 are maintained to be sufficiently high by adjustments. An adjuster tool (not shown) is prepared for this purpose.

The adjuster tool is comprised of a shift mechanism (not shown) which two-dimensionally shifts and moves a fixing tool (not shown) which fixes the position detection optical element 1, and a fixing base which fixes the target plate 4. The two-dimensional shift of the fixing tool and the shift mechanism is relatively given. The fixing tool and the shift mechanism are known as optical devices. The positional relationship between the fixing tool and the shift mechanism is properly adjusted in advance. As a result, the light receiving surface of the target plate 4 is made parallel to the two-dimensional shift surface of the shift mechanism. Also, the optical axis of the position detection optical element 11 is perpendicular to the light receiving surface. The PSD device 13 attached to this shift mechanism is arranged in and attached to the support structure of the shot position detector 2 as shown in FIG. 3. The target plate 4 along with the fixing tool is attached to the shot position detector 2. The positioning holes 17 described above are opened in this kind of fixing tool.

A laser is irradiated on the center point of the 10-score region on the target plate 4. The shift mechanism sequentially moves the position detection optical element 11 in a two-dimensional direction. The movement is executed in the direction in which the left side of the equation (1) expressed by current values Ix2 and Ix1 which are generated by the PSD device 13 at each point on the movement. The position where both (Ix2−Ix1) and (Iy2−Iy1) become zero is determined as the electric center point of the PSD device 13. The two-dimensional gauge of the shift mechanism at this time is recorded, and the electric center point of the PSD device 13 positioned in correspondence with the gauge is determined as the mechanical origin of the shot position detector 2.

The PSD device 13 is shifted in the x- and y-coordinate directions by the shift mechanism which fixes the PSD device 13 such that the electric center point corresponds to the mechanical origin. Then, (Ix2−Ix1) and (Iy2−Iy1) are measured. Next, the laser beam shot position is moved in the x-axis positive direction based on an interval between concentric circles. Next, the PSD device 13 is moved in the x-axis negative direction until (Ix2−Ix1) becomes zero. The gauge of the shift mechanism indicates the movement in the x-axis direction and the position x' is read with respect to the origin. Next, the laser shot point or laser spot is moved into the y-axis positive direction based on the length of the interval between concentric circles. Next, the PSD device 13 is moved in the y-axis negative direction until (Iy2−Iy1) becomes zero. The gauge of the shift mechanism indicates the movement in the y-axis negative direction and the position y7 is read with respect to the origin. The laser beam spot is moved on the surface of the target plate 4 in the x- and y-axis directions, to find zero points where (Ix2−Ix1) and (Iy2−Iy1) become zero, respectively. Thus, (x', y') is determined.

From the actual measurements as described above, the following functional relationships are obtained:

$$x'=jx$$

$$y'=ky$$

If mapping relationship of the optical system including lens is ideal, j and k are equal and constants. The combination (x', y') of this kind does not perfectly consistent with the coordinates (x, y) obtained from the equation (1) at that position, due to asymmetry described previously. Temporary relationship between (x', y') and (x, y) is expressed by an approximate linear relationship for every area. In this relationship, j and k change in accordance with first to fourth quadrants, and also change in accordance with the distance from the origin. It is preferable to divide the score region on the target plate 4 into a plurality of regions. Where the variable number of each region is expressed as s, $$x'=jsx$$

$$y'=jsy$$

are given. This set (js, ks) is set in form of a table in the transmission/reception signal control circuit 54 or the system control CPU 55.

The above-mentioned distortion correction can be executed based on fixture of the absolute position of the laser irradiation point and relative shift between the target plate 4 and the PSD device 13. However, the correction may be executed based on fixture of both of the target plate 4 and the PSD device 13, and the shift of the laser irradiation point. If distortion correction is carried out only by shifting the laser beam shot point, the laser beam is irradiated on the target plate 4. The laser beam shot position is watched with eyes to artificially read the coordinates (x, y), and output coordinates (x', y') of the PSD device 13 corresponding to the watched position are recorded. Variable conversion of (x, y) and (x', y') is the same as has already been described. The variable conversion is executed for every divided region, and can be expressed in a table for every divided region. In this case, no calculation is necessary. The coordinates (x, y) are not limited to orthogonal coordinates, but polar coordinates may be used in place of the orthogonal coordinates. The width of each divided region should be set to be broad in the region which is more distant than the electric center point of the PSD device 13 and narrower in the region which is closer than the electric center point of the PSD device.

The adjustment method for the same is executed by engineers under instructions from official referees in the shooting sport field. This adjustment to be carried out by an engineer should preferably easy. An easy adjustment method will be carried out as follows.

A laser beam generator is set in front of a shot position detector 2. A coordinate plate in which small holes are opened in the interval of 5 mm is positioned and attached to the target plate 4 in the front surface of the shot position detector 2. A laser beam emitted from the ray beam generator is irradiated on a hole situated at the center point of the coordinate plate. Electric coordinate values (x', y') outputted from the PSD device 13 of the shot position detector 2 are (0, 0) or other close coordinate values. The target plate 4 is finely moved together with the coordinate plate to adjust the position of the target plate 4, such that the electric coordinate values (x', y') become (0, 0). It is possible to adjust the position of the PSD device 13 without adjusting the position of the target plate 4. Through adjustment of this kind, the electric origin (0', 0') of the PSD device 13 corresponds to the mechanical origin (0, 0) of the target plate 4.

Next to this mechanical adjustment, mathematic adjustment is executed. A laser beam is irradiated on a hole adjacent to the hole corresponding to the origin of the coordinate plate. At this time, the coordinates (x, y) of the hole are (0, 5), (5, 0), or (5, 5) in units of mm. In this case, the output of the PSD device 13 does not always correspond to (5, 5). In general, the mechanical coordinate values (x, y) of the hole in the coordinate plate, which is irradiated with a laser beam, and the electric coordinate values (x', y') of the PSD device 13 corresponding to the coordinate values are not equal to each other. Between the mechanical coordinate values (x, y) and the electric coordinate values (x', y'), the above-mentioned coordinate conversion is carried out. The coordinate conversion of this kind is translational coordinal conversion or rotational coordinal conversion.

This kind of mathematic adjustment based on coordinate conversion is executed with respect to four quadrants shown in the figure. The quadrants α, β, γ, and ζ including the origin O and determined by the mechanical adjustment are adopted. Each of the quadrants α, β, γ, and ζ is a square region and includes the origin O. With respect to the quadrant α, the laser beam shot point is moved in the interval of 5 mm in the x-axis direction and the y-axis direction, and coordinates (x', y') based on the output of the PSD device 13 and corresponding to the coordinates (x, y) of the laser beam shot point are measured. The above-mentioned mathematic adjustment is executed. Also, this kind of adjustment is executed with respect to the other three quadrants.

Figure 14:
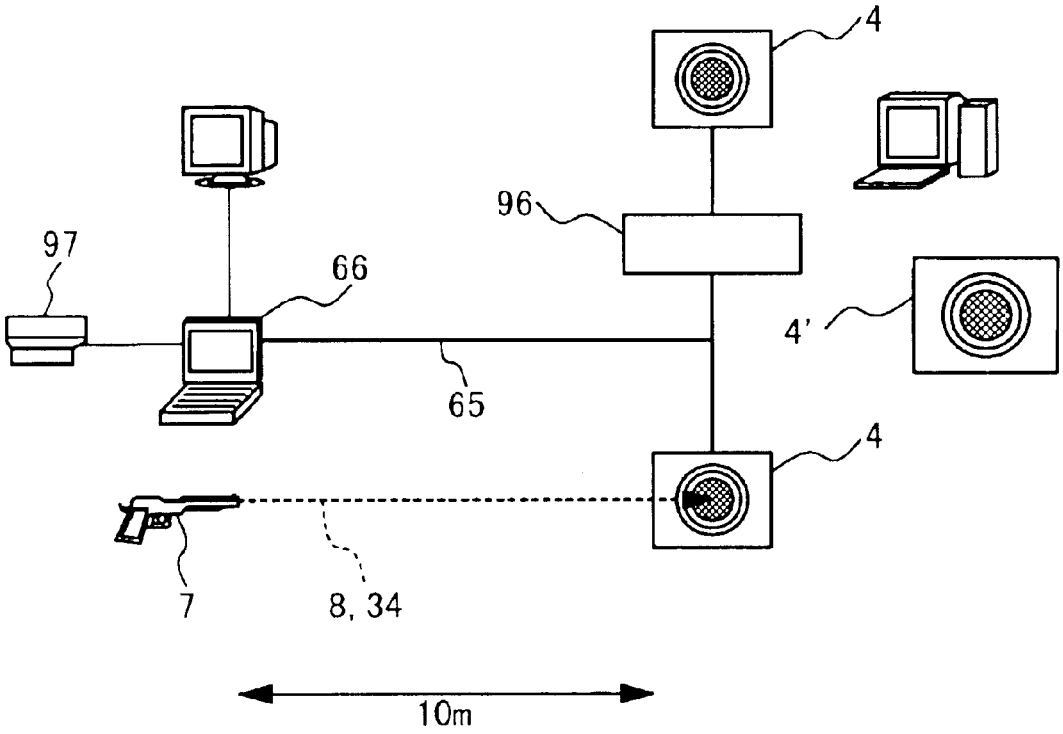
FIG. 14 is a system bock diagram showing the shooting system according to a second embodiment of the present invention.

FIG. 14 shows the entire system of a kind of shooting sport. The shot position detector 2 including a target plate 4 corresponding to the laser gun 7 of one shooter and the shot position detector 2 including the target plate 4 corresponding to the laser gun 7 of another shooter are together connected to the personal computer 66 through the LAN 65 described previously. Connection between the two target plates 4 and one personal computer 66 is selectively switched by a switching unit 96. The personal computer 66 displays the shooters' entry numbers, bullet numbers, scores corresponding to the bullet numbers, total scores, and shot positions where laser beam bullets have hit on the target plates 4, simultaneously or at intervals. Final score-count tables are outputted from a printer 97 connected to the personal computer 66. The target plates 4 may be replaced with target plates 4' for 25 m.

The plurality of elementary bullets contained in a single bullet are emitted in response to the single triggering operation, as shown in FIGS. 9C, 9D and 9E. Not only scores of these respective elementary bullets are averaged but also one score may be obtained from every elementary bullet. This score count method may make a difference between scores based on a fine fluctuation of the hand after pulling the trigger. Further, the characteristics of fluctuation of shooters may be numerically expressed by obtaining individually the score of a j-th elementary bullet of an n-th bullet. It is possible to provide a new sport style that could not be attained in the conventional shooting sport in which only one live bullet is shot. Further, the triggering action characteristic is numerically valued in form of a trace of shot positions of a plurality of laser beam bullets on a target plate 4, and swing of the trace is scored. In addition, knowing the swing can help correcting the triggering action in live-bullet shooting.

A transmission signal 8 may be emitted from the target side, and a signal corresponding to the transmission signal 8 may add to the laser beam bullet 34. Thus, invalidation of the laser beam bullets other than those having the corresponding signal, i.e., the laser beam bullets emitted from adjacent shooting boxes or emitted unconsciously in the shooting sport field can be carried out. Score calculation or shot position display such as display of traces is not carried out for those bullets. The laser beam bullet 34 emitted from the laser gun 7 has data such as a pulse width, and time corresponding to the transmission signal 8 as a permission signal. If the laser beam bullet emitted from another shooting box is emitted against the target plate 4 which does not correspond to the shooting box, the laser beam bullet emitted from another shooting box is invalidated.

In the above, the bullet timing signal is repeatedly outputted in response to the conical beam 8, and is used as the laser beam bullet or elementary bullet when the bullet identification signal is added. However, the bullet timing signal may be outputted only in response to the trigger operation and may be outputted with or without the bullet identification signal.

As described above in detail, according to the laser gun, target box, shooting box and laser gun shooting system according to the present invention, a signal is generated at the target as signals sufficient to allow a laser beam bullet to be shot. Thus, the shooting system is realized as not of the gun-oriented type but of the target-oriented type. Also, the intention of an organizer of the shooting sport gate has priority, and consequently the gun and the computer are not connected by any wire. As a result of combining a bullet timing signal and individual laser beam bullet signals, it is now possible to provide a system for establishing one-to-one correspondence between the laser gun and the target.

Shooting a laser beam is properly restricted by the organizer-oriented system to reliably improve the safety of the laser gun. As a result of serializing a bullet timing signal and individual signals, the accuracy and the speed of score calculating operations can be improved. The generation of signals at the gun side can diversify the competition.

The target box that is independent from the laser gun can be moved freely. Therefore, it can be installed at any desired position on the shooting sport field, and once the shooting box is appropriately positioned relative to the target box, the shooting sport game can be started immediately.

Furthermore, if the display of a personal computer or some other display screen is wired with the shooting box, the game is ready for starting so that the game can be held very smoothly.

What is claimed is:

1. A laser gun comprising:

a signal generating unit which generates an emission permission signal in response to a shooting permission signal, wherein said shooting permission signal is generated by a target;

a laser beam bullet emitting unit which emits a laser beam bullet based on said emission permission signal generated by said signal generating unit, and a trigger, wherein said laser beam bullet emitting unit generates said laser beam bullet based on said emission permission signal in response to an operation of said trigger, said laser beam bullet emitting unit emits a bullet timing signal, and emits said laser beam bullet in response to said bullet timing signal, and said laser beam bullet comprises a plurality of elementary laser beam bullets generated by a single diode, and a predetermined number of said elementary beam bullets are emitted for a single operation of said trigger.

2. The laser gun according to claim 1, wherein said laser beam bullet includes a laser beam bullet signal, and said laser beam bullet signal comprises a laser beam bullet identifying signal used to identify said laser beam bullet from other laser beam bullets emitted in response to another trigger operation and generated in response to the trigger operation.

3. The laser gun according to claim 2, wherein said laser beam bullet identifying signal includes a plurality of bullet distinguishing signals for said plurality of elementary beam bullets, and said plurality of bullet distinguish signals are sequentially emitted after said bullet timing signals, respectively.

4. The laser gun according to claim 3, wherein each of said plurality of bullet identifying signals includes:

an in-bullet signal associated with a corresponding one of said plurality of elementary laser beam bullets; and a common signal indicating that said corresponding elementary laser beam bullet belongs to said laser beam bullet.

5. The laser gun according to claim 4, wherein said in-bullet signal is expressed by a first number of bits, and said common signal and said second common signal is expressed by a second number of bits.

6. The laser gun according to claim 5, wherein said first number of bits is equal to 2 and said second number of bits is equal to 6.

7. The laser gun according to claim 1, further comprising a battery detachably arranged in an upper half portion of said laser gun.

8. The laser gun according to claim 1, further comprising a switch group arranged at a lower portion of said laser gun and used to define a state of said laser gun.

9. The laser gun according to claim 8, wherein each of swithches of said switch group has a projecting part allowing a gun shooter to touch and confirm a selected position of said laser gun.

10. The laser gun according to claim 8, wherein said switch group comprises a first switch used to define a power on/off state of said laser gun, and a second switch used to set said laser gun to one of a plurality of shooting modes.

11. The laser gun according to claim 10, wherein said plurality of shooting modes include a real shooting mode for allowing the emission of said laser beam bullet, and a test shooting mode for not allowing the emission of said laser beam bullet.

12. The laser gun according to claim 1, further comprising a grip section detachably fitted to a main body of said laser gun.

13. The laser gun according to claim 1, wherein said laser gun is cordless.

14. A laser gun shooting system comprising:

a laser gun which emits laser beam bullets in response to an emission permission signal which is generated in response to a shooting permission signal, wherein said shooting permission signal is generated by a target;

a shot position detector which receives and detects a plurality of said laser beam bullets emitted from siad laser gun;

a scoring unit which calculate a shooting score of said plurality of laser beam bullets against said shot position detector, said shot position detector transmitting said shooting permission signal to said laser gun repeatedly as a bullet timing signal in a predetermined time interval, said laser beam bullet comprising a plurality of elementary laser beam bullets, said laser beam bullet including a laser beam bullet identifying signal used to identify said laser beam bullet from other laser beam bullets, said laser beam bullet identifying signal including a plurality of bullet distinguishing signals for said plurality of elementary beam bullets, said plurality of bullet distinguish signals being sequentially emitted after said bullet timing signals, respectively, said shot position detector converting each of said plurality of laser beam bullets into an electric signal, said electric signal includes:

a common signal common to said plurality of elementary laser beam bullets, and a specific signal specific to each of said plurality of elementary laser beam bullets.

15. The laser beam bullet shooting system according to claim 14, further comprising:

a display apparatus which displays shot positions of said shot position detector shot by said plurality of laser beam bullets emitted from said laser gun.

16. The laser gun shooting system according to claim 14, wherein said scoring unit calculates, as said shooting score for said laser beam bullet, an average of scores for the plurality of shot positions of said plurality of elementary laser beam bullets based on said common signal and said specific signals.

17. The laser gun shooting system according to claim 14, wherein said scoring unit calculates, as said shooting score for said leaser beam bullet, a plurality of scores for said shot positions of said plurality of elementary laser beam bullets based on said common signal and said specific signals.

18. The laser gun shooting system according to claim 14, wherein said shot position detector generates a signal indicating a trace of the shot positions of said plurality of elementary laser beam bullets based on said common signal and said specific signals, and said laser gun shooting system further comprises a display unit which displays said trace based on said trace indicatin signal.

19. The laser gun shooting system according to claim 18, wherein said display unit is supported by said shot position detector.

20. The laser beam bullet shooting system according to claim 18, wherein said display unit is electrically connected to said shot position detector and separated from said shot position detector.

21. The laser beam bullet shooting system according to claim 14, wherein said laser gun comprises:

a signal generating unit which generates an emission permission signal in response to a shooting permission signal; and a laser beam emitting unit which emits a laser beam bullet based on said emission permission signal generated by said signal generating unit.

22. The laser beam bullet shooting system according to claim 21, further comprising a trigger, wherein said laser beam bullet emitting unit generates said laser beam bullet based on said emission permission signal in response to an operation of said trigger.

23. The laser beam bullet shooting system according to claim 21, further comprising a battery detechably arranged in an upper half portion of said laser gun.

24. The laser beam bullet shooting system according to claim 21, further comprising a switch group arranged at a lower portion of said laser gun and used to define a state of said laser gun.

25. The laser beam bullet shooting system according to claim 24, wherein each of switches of said group has a projecting part allowing a gun shooter to touch and confirm a selected position of said laser gun.

26. The laser beam bullet shooting system according to claim 24, wherein said switch group comprises a first switch used to define a power on/off state of said laser gun, and a second switch used to set said laser gun to one of a plurality of shooting modes.

27. The laser beam bullet shooting system according to claim 26, wherein said plurality of shooting modes include a real shooting mode for allowing the emission of said laser beam bullet, and a test shooting mode for allowing the emission of said laser beam bullet.

28. The laser beam bullet shooting system according to claim 21, further comprising a grip section detechably fitted to a main body of said laser gun.

29. The laser beam bullet shooting system according to claim 21, wherein said laser gun is cordless.

30. The laser beam bullet shooting system according to claim 21, wherein said laser beam bullet emitting unit emits a bullet timing signal regardless of existence or non-existence of the trigger operation, and emits said laser beam bullet in response to said bullet timing signal.

31. The laser beam bullet shooting system according to claim 30, wherein said laser beam bullet comprises a plurality of elementary laser beam bullets, and a number of said elementary beam bullets emitted for a signal operation of said trigger is predetermined.

32. The laser beam bullet shooting system according to claim 31, wherein said laser beam bullet includes a laser beam bullet signal, and said laser beam signal comprises a laser beam bullet identifying signal used to identify said laser beam bullet from other laser beam bullets emitted in response to another trigger operation and generated in response to the trigger operation.

33. A shot position detector used in a laser beam bullet shooting system, comprising:

a box main body;

a target supported by said main body;

a transmitting unit supported by said main body and adapted to transmit said shooting permission signal; and a light receiveing unit supported by said main box and adapted to receive said laser beam bullet.

34. The shot position detector according to claim 33, wherein said transmitting unit emits a conically-shaped light beam having a directionality directed to a shooting area for a laser gun as a shooting permission signal, and a laser beam bullet is emitted from a laser gun in response to said shooting permission signal.

35. The shot position detector according to claim 34, wherein a horizontal range of said directionality defines a horizontal range of said shooting area.

36. The shot position detector according to claim 33, wherein said transmitting unit further comprises a slit supported by said box main body, and arranged in front of said transmitting unit.

37. The shot position detector according to claim 36, wherein said slit is detachably secured to said box main body.

38. The shot position detector according to claim 33, wherein said target is detachable.

39. The shot position detector according to claim 38, wherein said target is secured in position by using a plurality of aligning holes arranged at said box main body and detachably fitted to said box main body.

40. The shot position detector according to claim 33, wherein said light receiving unit detects a shot position of said laser beam bullet based on a specific signal specific to said laser beam bullet.

41. The shot position detector according to claim 40, wherein said light receiving unit includes a photo-sensing device adapted to generate electric currents corresponding the shot position of said laser beam bullet.

42. The shot position detector according to claim 40, wherein said light receiving unit comprises:

an optical element which optically receives said laser beam bullets; and an electronic unit for converting each of the received laser beam bullets into an electric signal, and said electric signal includes a bullet number signal indicating a bullet number of said laser beam bullet.

43. The shot position detector according to claim 40, wherein each of said plurality of laser beam bullets contains a plurality of elementary laser beam bullets, said light receiving unit comprises:

an optical element which optically receives said laser beam bullets; and an electronic unit for converting each of the received laser beam bullets into an electric signal, and said electric signal includes:

a common signal common to said plurality of elementary laser beam bullets; and a specific signal specific to each of said plurality of elementary laser beam bullets.

44. The shot position detector according to claim 43, wherein any laser beam bullets emitted from said laser gun without said shooting permission signal are invalidated.

45. A shooting box used in the laser gun shooting system according to claim 14, comprising:

partition walls for partitioning and defining a shooting area for positioning said laser gun opposite to said shot position detector.

* * * * *